United States Patent [19]

Perdue et al.

[11] Patent Number: 4,710,137

[45] Date of Patent: Dec. 1, 1987

[54] CABLE STRAIN RELIEF

[75] Inventors: Terry A. Perdue, St. Joseph; William Cubbage, Coloma, both of Mich.

[73] Assignee: Zenith Electronics Corporation, Glenview, Ill.

[21] Appl. No.: 936,415

[22] Filed: Dec. 1, 1986

[51] Int. Cl.[4] ..... H01R 13/56

[52] U.S. Cl. ..... 439/457; 439/465

[58] Field of Search ..... 339/17 F, 176 MF, 210 M, 339/103 R, 103 M, 107, DIG. 1; 439/492–497, 457, 458, 465

[56] References Cited

U.S. PATENT DOCUMENTS

| | | | |
|---|---|---|---|
| 3,253,248 | 5/1966 | Brown | 339/17 F X |
| 3,740,698 | 6/1973 | Jerominek | 339/103 M X |
| 4,006,956 | 2/1977 | Allgaier | 339/DIG. 1 X |
| 4,351,579 | 9/1982 | Kordes et al. | 339/103 M X |
| 4,639,054 | 1/1987 | Kersbergen | 339/176 MF |

FOREIGN PATENT DOCUMENTS

| | | | |
|---|---|---|---|
| 4414744 | 10/1964 | Japan | 339/107 |

*Primary Examiner*—Eugene F. Desmond

[57] ABSTRACT

A plastic housing comprised of a pair of identical half sections joined along peripheral edges thereof so as to form a generally hollow shell structure having an elongated linear aperture and a circular aperture in facing end portions thereof encloses a printed circuit (PC) board. A flat ribbon cable extends through the elongated linear aperture, while a round cable extends through the circular aperture, with both cables coupled to the PC board. Elongated projections having a half-cylinder cross section are disposed immediately above and below each of the apertures on the facing end portions of the housing so as to restrict the bending of and limit the strain upon the cables extending from the apertures in the housing.

9 Claims, 4 Drawing Figures

CABLE STRAIN RELIEF

BACKGROUND OF THE INVENTION

This invention relates generally to a housing with an aperture through which extends an electrical conductor and is particularly directed to strain relief for an electrical conductor extending from a connector housing.

With each end of an electrical lead coupled to a respective circuit, the lead frequently extends through an aperture in a housing within which one of the circuits is disposed. The electrical lead may include a single conductor or a plurality of conductors either in the form of a flat ribbon cable or in the form of a twisted, multistrand cable. Whatever the form of the cable, it is frequently subject to bending distortion as it exits the enclosure or housing containing circuitry to which one end of the cable is connected. Repeated and continuous bending of the cable will eventually result in damage to and possibly breaking of either the electrical conductor, or conductors, or the insulating sheath encapsulating the conductor. This damage is caused by bending the cable to angular displacements which exceed the flexibility limitations of the insulation and/or conductor as well as contact between the cable and the edges of the housing defining the aperture through which the cable extends. In either case, bending of the cable over an extended period will result in a weakening of the cable, exposure of the conductors within the cable, and possibly breakage of the cable including the conductors therein.

In addressing this problem, the prior art has relied primarily upon the use of heat shrink tubing disposed about the cable as it transits an aperture in the housing. The heat shrink tubing protects the cable from abrasion caused by rubbing against the edges of the panel defining the aperture. The relative stiffness of the tubing also limits the radius of curvature to which the cable may be bent for reducing the possibility of "kinking" the cable resulting in possible exposure and breakage of the conductors within the cable. However, the use of heat shrink tubing around the cable increases the cost and complexity of the cable installation and thus has only limited commercial appeal. Moreover, the heat shrink tubing itself is subject to permanent distortion and breakage arising from extensive bending action over an extended period and thus offers only limited protection for the electrical conductors and their outer insulating sheath.

The present invention provides strain relief for an electrical cable which does not suffer from the limitations of the prior art through the use of a uniquely configured surface of a panel positioned immediately adjacent to an aperture through which the cable passes so as to limit the angular displacement to which the cable may be bent. The strain relief arrangement of the present invention also provides protection for the cable from excessive pulling forces using an inexpensive, easily fabricated and assembled, and highly reliable cable installation arrangement.

OBJECTS OF THE INVENTION

Accordingly, it is an object of the present invention to provide strain relief for an electrical lead or cable.

It is another object of the present invention to provide an inexpensive, easily assembled and structurally strong housing for a PC board which affords strain relief for electrical leads extending therefrom.

It is yet another object of the present invention to provide a connector arrangement for an electrical lead which minimizes the possibility of deforming or damaging the lead by limiting the bend radius of the lead.

A further object of the present invention is to provide a more reliable coupling arrangement for an electrical cable.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
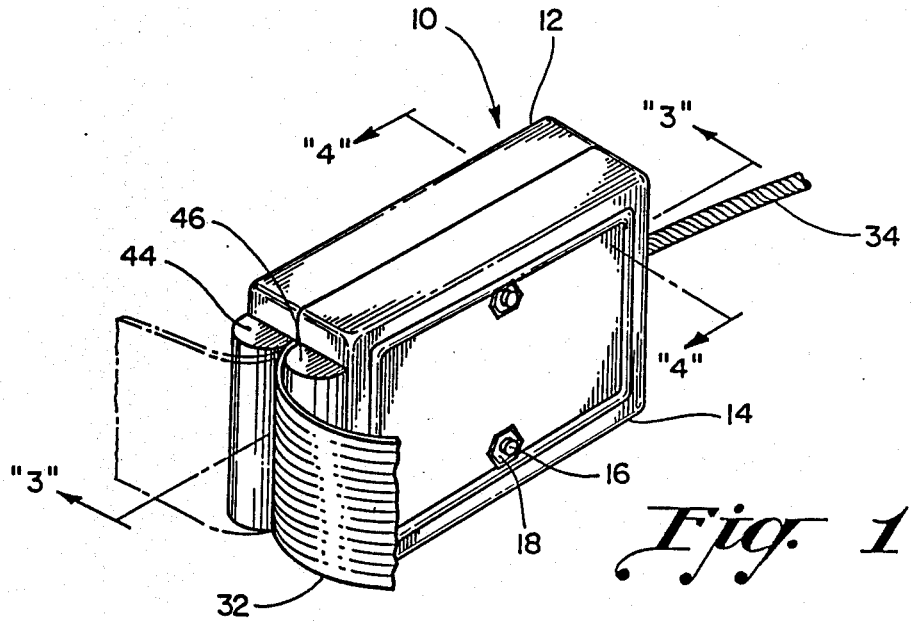
FIG. 1 is a perspective view of a cable strain relief arrangement in accordance with the present invention.
Figure 2:
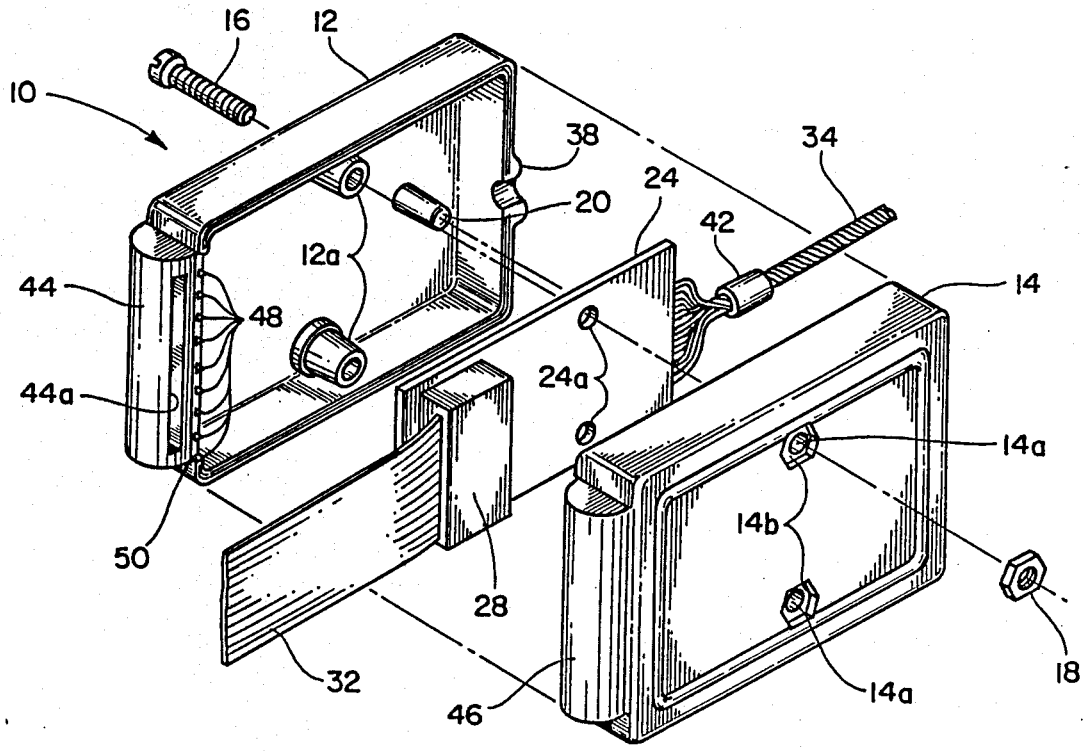
FIG. 2 is an exploded view of the cable strain relief arrangement of FIG. 1.
Figure 3:
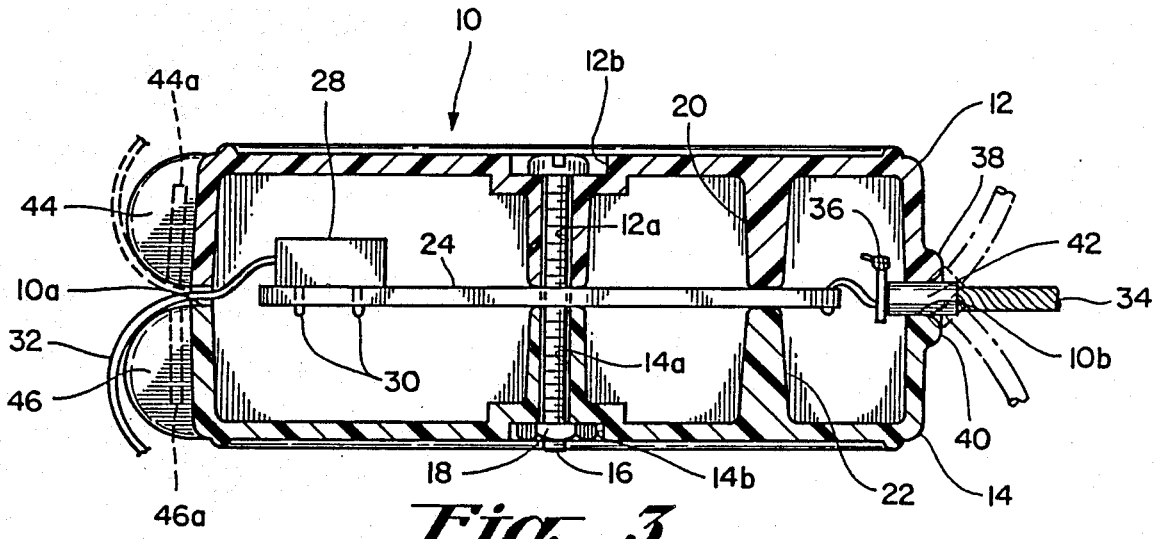
FIG. 3 is a sectional view of the cable strain relief arrangement of FIG. 1 taken along sight line 3—3 therein.
Figure 4:
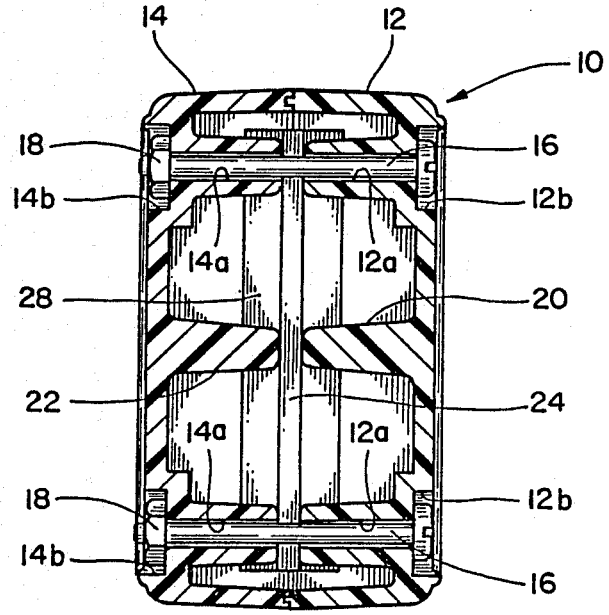
FIG. 4 is a vertical sectional view of the cable strain relief arrangement of FIG. 1 taken along sight line 4—4 therein.

Referring to FIGS. 1 and 2, there are respectively shown perspective and exploded views of a strain relief housing 10 in accordance with the principles of the present invention. FIGS. 3 and 4 are sectional views of the strain relief housing 10 of FIG. 1 respectively taken along sight lines 2—2 and 3—3 therein.

The strain relief housing 10 includes first and second housing sections 12 and 14 which are substantially identical in size, shape and configuration. The first housing section 12 includes a pair of spaced apertures **12*a* and associated recessed portions 12*b* continuous therewith. Similarly, the second housing section 14 includes a pair of circular apertures 14*a* therein and respective recessed portions 14*b* continuous therewith. The first and second housing sections 12, 14 are adapted for interfitting engagement around a substantial portion of the peripheral edges thereof, with first and second apertures 10*a* and 10*b* disposed along the line of joinder of the two housing sections and positioned within opposed lateral surfaces of the housing 10. The first aperture 10*a* is generally linear and elongated in shape, while the second aperture 10*b* is generally circular. In one embodiment, the facing edge portions of the first and second housing sections are provided with a complementary tongue-and-groove arrangement as shown in FIG. 4** to provide more secure engagement between the housing sections.

A first flat, ribbon-like cable 32 is positioned within and extends through the first aperture **10*a* within the strain relief housing 10, while a second round cable 34 is disposed within and extends through the second aperture 10*b* in a facing lateral surface of the strain relief housing. The flat ribbon cable 32 typically includes a plurality of spaced, parallel conductors about which is disposed an insulating sheath. The round cable 34 may be comprised of a single insulator-sheathed conductor or a plurality of conductors arranged in a twisted configuration. Heat shrink tubing 42 may be disposed about the round cable 34 as it exits the second aperture 10***a* within the strain relief housing 10, although such heat shrink tubing is not essential for the present invention and may, in fact, be eliminated because of the unique configuration of the strain relief housing 10 of the present invention as described below. In addition, a cable tie 36 within the housing 10 may provide additional strain relief for the round cable 34.

With the first and second housing sections 12, 14 placed in abutting contact so as to form a substantially enclosed structure, the strain relief housing is adapted to receive and support a PC board 24. The PC board 24 also includes a pair of spaced apertures 24*a*, each adapted to receive one of the threaded coupling pins 16. The PC board 24 is engaged by those portions of the first and second housing sections 12, 14 defining the apertures 12*a*, 14*a* therein. In addition, the inner portions of the first and second housing sections 12, 14 are each provided with a respective circuit board stabilizer boss 20, 22, the respective distal end portions of which engage and provide support for the PC board 24. In this manner, the PC board 24 is securely maintained in a stable position within the strain relief housing 10.

The flat ribbon cable 32 extends through the first aperture 10*a* within the strain relief housing 10 and is engaged by an elongated connector 28 positioned within the strain relief housing. Extending from the connector 28 along the length thereof are a plurality of pins 30 which are electrically coupled to and in contact with the conductors within the flat ribbon cable 32. Positioned on the edge of the PC board 24 is the edge connector 28 which is adapted to receive the pins 30 extending from the cable connector 28 for electrically coupling the various conductors in the flat ribbon cable 32 to circuitry on the PC board 24. The edge connector 28 is typically adapted to engage a plurality of spaced conductors (not shown) positioned adjacent to the edge of the PC board 24 in a conventional manner such as by direct soldering to the conductors on the PC board.

The lateral panels of the first and second housing sections 12, 14 positioned adjacent to the first aperture 10a in the strain relief housing 10 are provided with respective first curvilinear projections 44 and 46. Similarly, the lateral panels of the first and second housing sections 12, 14 positioned adjacent to the second aperture 10*b* within the strain relief housing 10 are provided with respective second curvilinear projections 38 and 40. The second curvilinear projections 38, 40 of the first and second housing sections 12, 14 extend beyond the width of the second aperture 10*b* of the strain relief housing 10. For use with the flat ribbon cable 32, the first curvilinear projections 44 and 46 of the respective first and second housing sections 12, 14 extend substantially the length of the first elongated, linear aperture 10*a* in the strain relief housing 10. Each of the curvilinear projections on the first and second housing sections 12, 14 is provided with a generally semicircular cross section and is in the form of a half-cylinder for engaging and limiting the angular displacement, or bending, of the cables extending from the strain relief housing 10. The bending limits to which the flat ribbon cable 32 and the round cable 34 may be subjected by virtue of the curvilinear projections on the facing edges of the strain relief housing 10 are shown in dotted line form in FIG. 3. By thus limiting the bending of these cables, the likelihood of damage to either the cable's insulating sheath or the conductors within the cable is substantially eliminated. In addition, by limiting the rotational displacement of the flat ribbon cable 32 and the round cable 34, these cables are much less likely to be disconnected from the PC board 24 within the strain relief housing 10 as a result of pulling forces exerted on the cables. The half-cylinder shapes of the curvilinear projections immediately adjacent to the apertures within the strain relief housing 10 determine the minimum bend radius of the cable as it exits the housing.

Each of the larger first curvilinear projections 44 and 46 in the adjacent lateral portions of the first and second housing sections 12, 14 is provided with a respective slot 44*a* and 46*a* extending substantially along the length thereof. The slots 44*a* and 46*a* reduce the amount of material required for the fabrication of the first and second housing sections 12, 14 of the strain relief housing 10, which preferably is comprised of a moldable plastic. In addition, the pair of elongated linear slots 44*a*, 46*a* reduce the volume of plastic required on the lateral edge portions of the first and second housing sections 12, 14. A large volume of plastic in this area would tend to cool slower during the molding process than the remaining portion of the housing section causing possible deformation in this portion of the housing section. Any deformation adjacent to where a cable exits the strain relief housing 10 could change the maximum bending angle of the cable and could lead to damage or breakage of the insulating sheath and/or conductors within the cable. Positioned on an edge recess 50 in each of the first and second housing sections 12, 14 are a plurality of teeth-like bosses 48 for engaging the insulating sheath of the flat ribbon cable 32. These bosses 48 prevent the flat ribbon cable 32 from being displaced by pulling forces within the first aperture 10*a* defined by the adjacent, facing edge recesses 50 within the first and second housing sections 12, 14.

There has thus been shown a cable housing which provides strain relief for an electrical lead or cable passing through an aperture within the housing. By providing curvilinear outer portions in a generally half-cylinder shape on opposed sides of the aperture from which the cable exits the housing, the bending radius of the cable is limited to the flexibility limits of the cable thus avoiding the imposition of excessive bending strain on the cable. In addition, the smooth curvilinear shape of those portions of the housing positioned immediately adjacent to the aperture through which the cable exits prevents abrasion of the cable and damage to or breakage of its electrical conductors and insulating sheath.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use in a housing having a first elongated aperture defined by at least one inner edge of said housing through which a first single flat electrical cable extends and a second aperture through which a second electrical cable having a generally circular cross-section extends, an arrangement for limiting the bending strain exerted upon the electrical cables comprising:

a first housing section having first and second recessed edge portions;

a second housing section having third and fourth recessed edge portions, said first and second housing sections being of identical size and configuration and adapted for engagement along respective edges thereof and wherein said first and third recessed edge portions are disposed adjacent to one another so as to form the first elongated aperture in the housing and said second and fourth recessed edge portions are disposed adjacent one another so as to form the second generally circular aperture in the housing;

a first convex projection disposed on an outer surface of said first housing section immediately adjacent to the first recessed edge portion thereof;

a second convex projection disposed on an outer surface of said second housing section immediately adjacent to the second recessed edge portion of said second housing section, wherein said first and second convex projections each have a given radius of curvature which limit the angular bending of and the bending strain exerted upon the first single flat electrical cable;

a first curvilinear projection disposed on the outer surface of said first housing section adjacent to the second recessed edge portion thereof;

a second curvilinear projection disposed on the outer surface of said second housing section adjacent to the fourth recessed edge portion thereof, wherein said first and second curvilinear projections limit the angular bending of and the bending strain exerted upon the second generally circular electrical cable; and first and second bosses coupled respectively to said first and second housing sections for engaging opposed surfaces of a PC board positioned within the housing and coupled to the first and second electrical cables in maintaining the PC board securely in position within the housing.

2. The arrangement of claim 1 wherein said first and second sections form a substantially closed housing when coupled together.

3. The arrangement of claim 1 further including an insulating sheath disposed about the second cable and positioned within the second aperture in the housing.

4. The arrangement of claim 3 wherein said insulating sheath is comprised of heat shrink tubing.

5. The arrangement of claim 1 wherein the first electrical cable is a flat ribbon cable having a plurality of spaced conductors extending along the length thereof and wherein each of said first and second convex projections have generally half-cylindrical cross sections and include a longitudinal axis aligned with said flat ribbon cable along the width thereof.

6. The arrangement of claim 5 wherein the first aperture in the housing is in the form of an elongated linear slot and wherein the housing includes a plurality of bosses on an edge thereof extending into the first aperture so as to engage and securely maintain said flat ribbon cable in position within the aperture.

7. The arrangement of claim 6 wherein said flat ribbon cable includes a plurality of spaced conductors and an outer insulating sheath and wherein said plurality of bosses engage the outer insulating sheath of the flat ribbon cable.

8. The arrangement of claim 1 wherein said first and second convex projections are respectively disposed on adjacent opposed portions of said first and second sections forming the housing.

9. The arrangement of claim 8 wherein said first and second housing sections are comprised of plastic and wherein each of the first and second convex projections include an elongated, linear slot extending substantially the length of said convex projection.

* * * * *